US006371864B1

(12) United States Patent
Norwood

(10) Patent No.: US 6,371,864 B1
(45) Date of Patent: Apr. 16, 2002

(54) ALIGNMENT DEVICE FOR GOLF PUTTING PRACTICES

(76) Inventor: John M. Norwood, 106 B Vincente Rd., Berkeley, CA (US) 94705

( * ) Notice: Subject to any disclaimer, the term of this patent is extended or adjusted under 35 U.S.C. 154(b) by 0 days.

(21) Appl. No.: 09/576,617

(22) Filed: May 23, 2000

Related U.S. Application Data

(60) Provisional application No. 60/136,706, filed on May 28, 1999.

(51) Int. Cl.[7] ..... A63B 69/36
(52) U.S. Cl. ..... 473/220
(58) Field of Search ..... 473/219, 220, 473/226, 227, 266, 268

(56) References Cited

U.S. PATENT DOCUMENTS 5,388,832 A * 2/1995 Hsu ..... 473/220
5,464,221 A * 11/1995 Carney ..... 473/220
5,464,222 A * 11/1995 Carney ..... 473/220
5,611,739 A * 3/1997 Carney ..... 473/220
5,624,327 A 4/1997 Smith
5,640,777 A 6/1997 Densberger
5,709,609 A 1/1998 Carney
5,725,439 A * 3/1998 Halsey et al. ..... 473/220
5,980,393 A * 11/1999 Molinaroli ..... 472/220
6,066,052 A * 5/2000 Li ..... 473/220
6,149,537 A * 11/2000 Hooker ..... 473/220 X
6,227,983 B1 * 5/2001 Yang ..... 473/220
6,238,298 B1 * 5/2001 Chen ..... 473/220

* cited by examiner

*Primary Examiner*—Raleigh W. Chiu
(74) *Attorney, Agent, or Firm*—Howard E. Labowitz

(57) ABSTRACT

An apparatus and method for teaching golfers proper putting fundementals. The apparatus comprises a device which removably mounts over a putter head, projecting a laser beam on the plane perpendicular to the striking face of a putter just over the sweet spot. The apparatus also includes a means for the golfer to properly align the eyes vertically above the striking face. The laser beam is directed towards and on a linearly calibrated target strip. By directing a shot at various positions on the target strip while viewing the putter from a proper vertically aligned position, a golfer is able to learn to judge putting situations.

24 Claims, 3 Drawing Sheets

ALIGNMENT DEVICE FOR GOLF PUTTING PRACTICES

This application claims the benefit of Provisional Application 60/136,706 filed May 28, 1999.

BACKGROUND OF THE INVENTION

1. Field of the Invention

The field of the invention is training devices used with putters to train golfers to putt properly.

2. Description of the Prior Art

Putting is a very important part of the game of golf. On a standard par 72 course, half of the allotted strokes toward par are allocated for putting. There are at least two important aspects in learning to be a good putter, these include proper alignment of the putter blade with respect to the target, and proper alignment of the golfer's eyes with respect to the ball. The importance of proper alignment of the putter blade with respect to the target is self evident since the object of putting is to accurately control the trajectory of the ball. The importance of eye position is that without ones eyes directly over the ball, the golfer cannot properly determine and learn the correct relationship between the putter face and the target. The importance of proper eye position in putting was pointed out by Jack Nicholas in his book, *Golf My Way.*

The importance of correct eye position has been pointed out in several U. S. Patents, which attempt to address the problem by various alignment devices involving lines and reflective surfaces. Examples of these devices include U.S. Pat. No. 4,601,472, which is a device that mounts on a putter head with an eye aligning mirror and a target aligning mirror, and U.S. Pat. No. 5,913,732 which involves stringing a target line to the hole and sighting the ball through the line. Other systems include aligning indicia which are a permanent part of the club.

Another device disclosed in U.S. Pat. No. 5,624,327 uses a flat plate which sits on the ground with a depression to hold a golf ball and a head position indicator behind the ball which is only visible when the user's head is in the right position and which changes color when the user moves his head.

Various laser devices have been disclosed. Some of these, such as U.S. Pat. No. 5,029,868, involve a laser generator which is part of the club itself. In that patent, a laser device is contained in the grip portion of the club where beams are conveyed by optical fibers to the putter and emitted from the face towards a target of side-by-side parallel reflective strips. Other devices such as U.S. Pat. No. 5,709,609 discloses various means of removably mounting various laser pointing devices in golf club heads.

The laser devices are an important contribution to putter training. The laser devices can only be used, however, in practice and a not during regulation play. It is thus important that a training device be removable, so that players can use it to train on their regulation putters. It is likewise important that the learning take place while the golfer's eyes are vertically aligned over the ball.

Another problem in learning to putt is that greens are not typically flat. Many are sloped such that one often needs to aim the putter blade at a point which is to the left or right of the hole. It is important that a training system be able to provide feedback, regarding the relationship between where the putt is directed and where the ball travels and comes to rest. It is important that this feedback be learned from well aligned putts.

There is a need for a putter training device that can be removably mountable on regulation putters which concurrently provides the user with a means to align the putter blade at a specific target location while the golf ball is in position and with a means to assure that the golfer's eyes are properly positioned vertically over the ball.

There is a need for a system and method for a golfer to learn the relationship between properly aligned putter face, the target and the path of the ball.

There is a need for a system and method for a learning golfer to systematically vary the direction in which the ball is targeted while maintaining proper eye position and putter face alignment.

SUMMARY OF THE INVENTION

An object of my invention is to provide a putter training device which can be removably attached to a putter and will be useful in training a golfer to align the putter blade with respect to a target while a golf ball is in place, and concurrently to align the eyes directly over the ball so as to observe the correct relationship between the putter blade, the ball, and the target.

A further object of my invention is to provide a visible laser beam originating just above the golf ball which displays a straight path along a plane normal to the putter surface and on target.

A still further object of my invention is to provide a calibrated target strip on which the laser beam is visible to the golfer.

A still further object of my invention is to provide a method for using the device and the calibrated target strip to learn the relationship between the direction at which the ball is targeted and a real or simulated golf hole.

A still further object of my invention is to provide a method for using the device and the target to evaluate the path of the putting stroke by observing the movement of the laser beam on the target, with respect to calibration lines.

My invention is an apparatus for practicing the art of golf putting. In one embodiment of the invention the apparatus includes an alignment device which can be removably mounted on a putter. The device has an enclosure that contains a laser emitting unit which produces a laser beam which passes out of the enclosure through a first aperture. The enclosure is mounted on the putter directly over the putter blade's "sweet spot" so that the laser beam follows a path which is in a plane normal to the striking surface of the putter blade. In a preferred embodiment, the enclosure also has a lens which converts the laser beam into a line beam. The enclosure also contains a light source and a second aperture which are located within the enclosure so that the light source and the second aperture fall on a vertical line when the enclosure is mounted on the golf club with the laser beam directed in a plane normal to the striking surface of the putter. The opening in the aperture is smaller than the diameter of the light source, which is preferably a light emitting diode. The enclosure is mounted on the golf club just above the blade and behind the striking surface, with the laser beam directed on a plane normal to the striking face and the second aperture directed upward. The golfer's eyes are aligned properly when the intensity of the image viewed through the second aperture is maximized. The combination of the laser beam and the light source provide a means for concurrently aligning the putter blade with a target while properly viewing the putter blade, the ball, and the target with the eyes vertically aligned with the putter blade striking surface.

The apparatus also includes a calibrated linear target strip with vertical calibration lines. The calibrated strip can be used on a golf course green or indoors or on another surface. When used on a green, the calibration strip is oriented to the left or right of the hole depending on the slope, with the origin of the target centered over the hole. The laser line beam is visible to the golfer on the target. When practicing, a golfer can align the beam with different offsets from the hole and iterate at different offsets until the desired performance is obtained. The golfer can also observe whether the putter blade is moving properly along the target line by observing the movement of the laser line on the target. On a flat surface, the putter blade is properly soled when the laser line is vertical (parallel to the calibration lines). The putting stroke is properly aligned along the target line when the laser line indicates no horizontal movement along the target.

BRIEF DESCRIPTION OF THE DRAWINGS

These and other features, aspects and advantages of the present invention will become better understood with regard to the following description, appended claims and accompanying drawings, where:

DESCRIPTION

Figure 1:
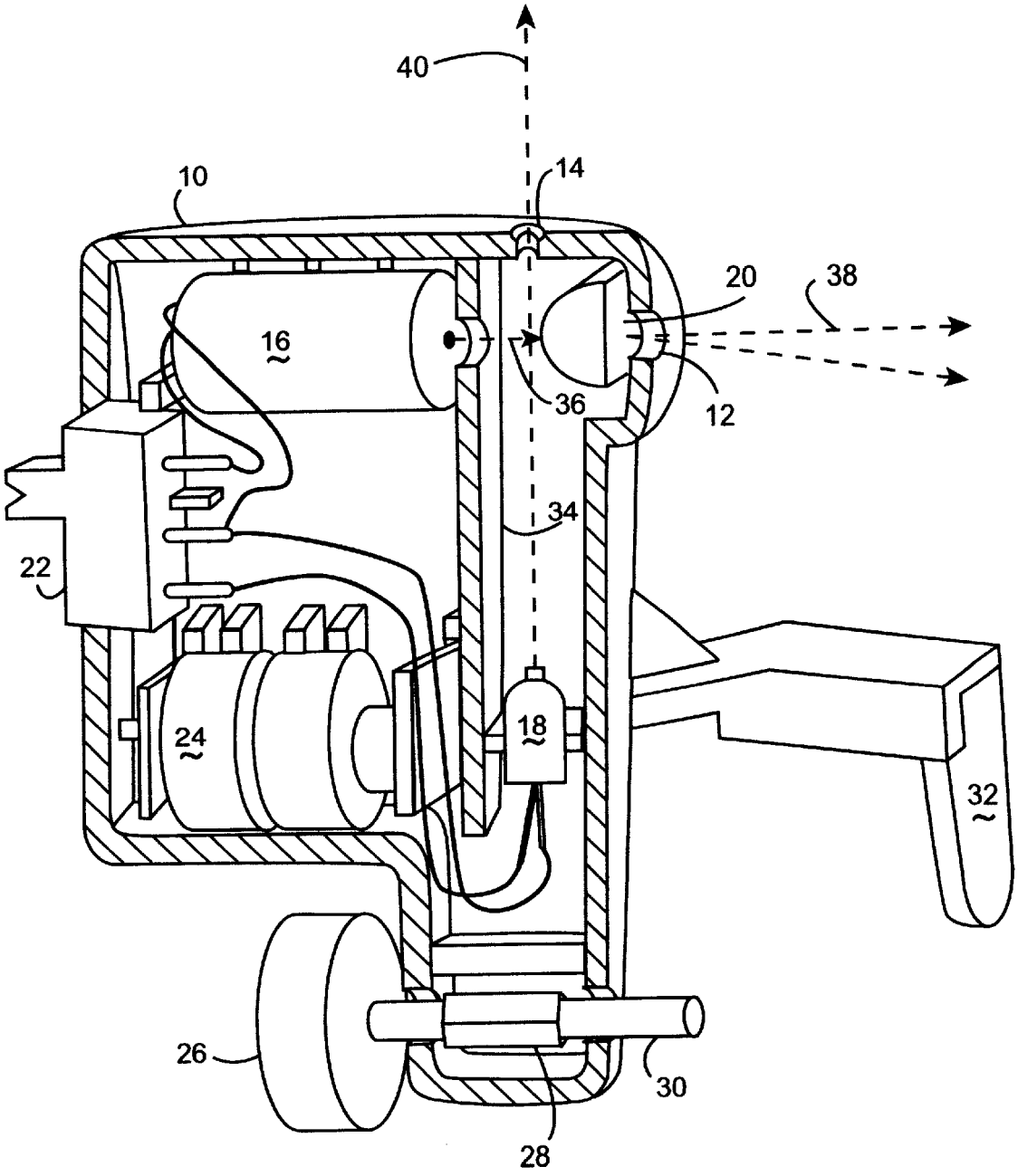
FIG. 1 is a cutaway perspective view of the alignment device showing the internal components.

FIG. 1 shows a perspective view of the alignment device showing the enclosure 10, the first aperture 12, the second aperture 14, the laser unit 16 and the light source 18, a light emitting diode (LED). A lens 20 is shown between the laser unit and the first aperture. The light emitting diode is shown mounted within the enclosure between a vertical guide surface 34 and the inner wall of the enclosure. A beam of light 36 is shown emanating from the laser unit and converted into a line of light by the lens between light rays 38. A vertical beam of light 40 is shown emanating from the LED.

Also shown within the enclosure are a battery voltage source 24, an on-off switch 22, and wires connecting the light source and laser unit through the switch. The enclosure is mounted to a golf club by a bracket including a vertical surface 32 which fits in front of the striking surface and an opposing screw which is threaded through a threaded attachment 28 to the enclosure and operated by a thumb wheel 26.

The other side of the enclosure is a mirror image of the side shown, without additional internals.

Figure 2:
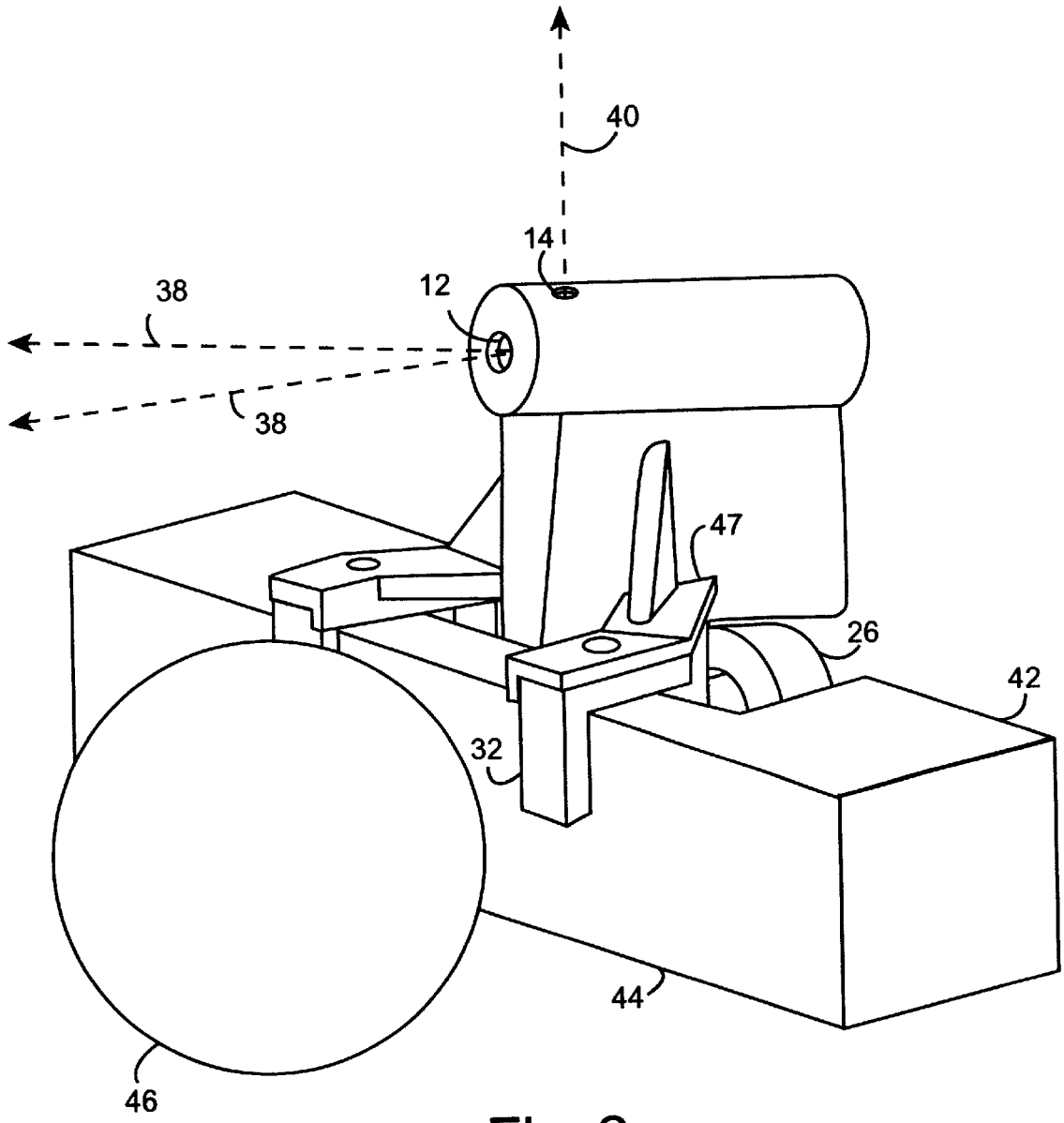
FIG. 2 is a perspective view of the alignment device mounted on a putter blade with a ball in place.

FIG. 2 shows the device mounted on the blade 42 of a putter between vertical surfaces 32 and the screw operated by thumb wheel 26. The vertical surfaces 32 are shown attached to the enclosure by bracket 47.

The laser line depicted by rays 38 emanate on a plane normal to the putter blade striking surface 44. The vertical ray 40 emanating from aperture on the top of the device is above and behind the striking surface 44, and the golf ball 46.

Figure 3:
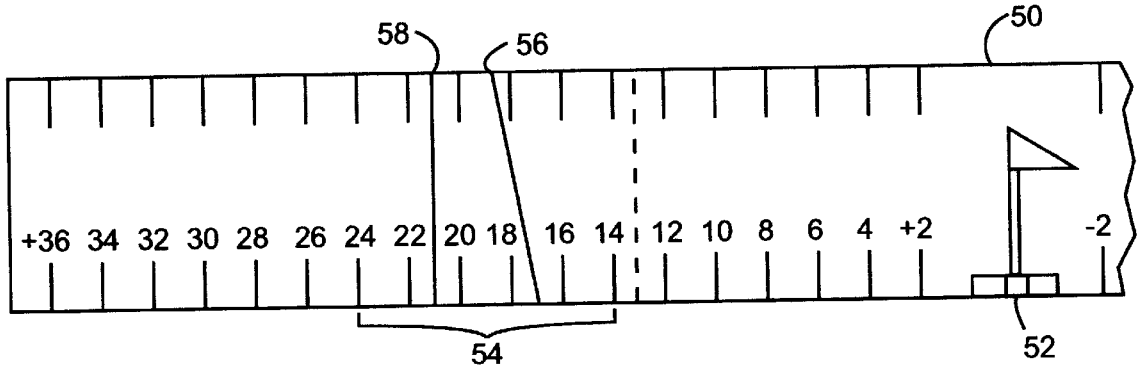
FIG. 3 is the target strip.

FIG. 3 shows the left half of the calibrated target strip 50. The strip has a number of vertical calibration lines 54 which show the distance from the outside edge of the hole 52. Line 58 depicts a laser line from a properly soled and executed putting stroke, and line 56 depicts the laser line from an improper stroke where the putter was not soled properly. A putter is properly soled when while addressing the ball, the bottom of the putter head rests on the ground as it was designed to rest.

My invention is an apparatus for practicing the art of golf putting. In a preferred embodiment of the invention the apparatus includes an alignment device which can be removably mounted on a putter by hand. The device has an enclosure which contains a laser emitting unit which produces a laser beam which passes out of the enclosure through a first aperture. The enclosure is mounted on the putter directly over the putter blade "sweet spot" so that the laser beam follows a path which is in a plane normal to the striking surface of the putter blade. The enclosure also contains a light source and a second aperture which are located within the enclosure so that the light source and the second aperture fall on a vertical line when the enclosure is mounted on the golf club with the laser beam directed in a plane normal to the striking surface of the putter. In a preferred embodiment, the opening in the aperture is smaller than the diameter of the light source, which is preferably a light emitting diode. When the enclosure is mounted on the golf club just above blade and behind the striking surface with the laser beam directed on a plane normal to the striking face and the second aperture directed upward, the golfer's eyes are aligned properly when the intensity of the image viewed through the second aperture is maximized. The combination of the laser beam and the light source provide a means for concurrently aligning the putter blade with a target while properly viewing the putter blade, the ball, and the target with the eyes vertically aligned with the putter blade striking surface.

The laser emitting unit is preferably a small consumer laser such as are commonly used in laser pointers. A preferable laser emitting device is a class III laser. The laser is located to direct its laser beam through a first aperture on the side of the enclosure. The enclosure is mounted on the head of a putting club just above the striking surface which is usually substantially planar and is designed to sit in a substantially vertical position when the ball is struck. The striking surface of a putter generally has a "sweet spot" usually near the center of the blade, which is the desired location on the striking face to strike the ball. There are generally markings on the putter head to indicate the position of the sweet spot. The laser unit is mounted within the enclosure and the enclosure is mounted on the golf club head so that the laser beam is directed just above the sweet spot marking in the plane perpendicular to the striking surface at the sweet spot of the putter. The laser beam is preferably directed on a line on the perpendicular plane which is nearly perpendicular to the striking surface. The reason for this will become apparent below, because the apparatus can be used advantageously with a target strip which is placed on the golf course near the hole at which the putt is directed, and if so used it is important that the beam be visible on the target strip.

In a preferred embodiment of the invention, a lens or sequence of lenses is located between the laser unit and the first aperture which converts the laser beam into a laser line. The lens may be physically separate from the laser unit or it may be incorporated within a single container package often known as a laser line generator. A lens which is suitable to convert a laser beam into a line beam is a cylindrical lens, although other multiple element lenses are also acceptable. Lenses of this type are often described by their fan angle, which describes the angle of the arc enclosing the line as emitted from the lens. Fan angles from about 4° to 90° are readily available. The fan angle will determine the length of the line as it appears at the target, as well as the intensity of the line. The higher the angle the longer the line will be and, for a given powered laser, the lower will be the intensity of the line. In general, it is preferable to use a smaller fan angle and have a more intense line visible at the target strip. The relationship between distance and line size is shown in the table below for 4° and 45° fan angle lenses.

TABLE

Relationship between line height and distance as a function of fan angle

| Fan Angle | 4° | 45° |
|---|---|---|
| Line height at 5 ft. | 0.35 ft. | 4.14 ft. |
| Line height at 10 ft. | 0.70 ft. | 8.28 ft. |
| Line height at 25 ft. | 1.75 ft. | 20.70 ft. |

The fan angle determines the maximum preferred amount that the laser beam can be inclined with respect to a horizontal line perpendicular to the striking face. In a preferred embodiment of the invention, the laser beam should be visible on a target strip set at distances between about 5 feet and about 25 feet from the putter.

The laser means can be a laser emitting unit described above, which could be an ordinary laser, a laser diode device, or an intense light beam of another sort which emits an intense light beam such as a laser device.

There are several preferred arrangements for the vertical alignment means for aligning the eyes vertically over the putter striking face. The first embodiment is a small light disposed within the enclosure so as to be on a vertical line with a second aperture located in the top of the enclosure when the apparatus is mounted on a putter head with the laser beam directed on a line in the plane perpendicular to the putter striking surface. Ideally, the second aperture will fall as close as possible to being over the striking surface of the putter. The second aperture should be smaller than the diameter of the light, preferably with an opening about half the size of the diameter of the light or less. A light emitting diode (LED) is a preferred light source. When viewed from above by a golfer, the LED is only visible when the golfer's eyes are in close proximity to a vertical line above the top hole. Also, as the golfer moves his head on an arc from one side of vertical through vertical to the other side, there is an identifiable optical response where the light is fully visible and of maximum intensity when viewed by the golfer along the vertical line from the top aperture. The response can be made clearer by including a vertical guide which confines the light to a relatively narrow column within the enclosure between the light source and the aperture.

The appearance can be varied by adjusting the relative size of the light source compared to the aperture and the distance that the light source is displaced below the aperture. A preferred set of dimensions is a ⅛ inch LED located ¾ inch below a 3⁄64 inch diameter aperture, within an enclosure which is about 1.25 inches×1.25 inches×0.5 inches, though many equivalent sets of dimensions are possible.

An alternative embodiment includes the use of a convex LED. In a convex LED, the light output is already focused along a single line, so the positioning within the enclosure and the relative size of the light source and the aperture are less critical.

A preferred mounting means as shown in the figures comprises a pair of vertical brackets attached to the outside of the enclosure and an opposing thumb screw. The mounting device must securely attach the apparatus to the putter head over the sweet spot, with the laser beam directed on the plane substantially perpendicular to the striking face of the putter. Many alternatives will be obvious to those skilled in the art, such as brackets attached to the enclosure and fitting on the striking surface of the putter and the back opposing surface and tightening screws for securing the brackets between the surfaces. Other illustrative mounting means include bonding surfaces such as adhesive or Velcro type bonding to bond the enclosure to the top surface of the putter head or to bond a surface attached to the enclosure to a surface of the putter head. The apparatus may also be attached to the shaft of the putter and held out over the head by a support member. It is preferred that the mounting be such that the apparatus is readily removable from the putter so that a golfer can use the putter to practice with the apparatus in place or for regulation golf play with the apparatus removed. It is preferred that the mounting device not require distinctive drilling or other permanent modification of the putter. The mounting device preferably does not require tools or a complicated installation. Many variations will be obvious to those skilled in the art for removably mounting the apparatus so that the laser beam is directed along a line on a plane perpendicular to the striking face and the vertical aligning means is directed upwards.

The enclosure can be made of any appropriate light weight material such as high-strength plastic or aluminum. The enclosure can be readily made in two pieces which are attached together after the components are put inside. The enclosure preferably has support surfaces to hold the components in place. The components are attached to the enclosure by a method appropriate to the materials, such as soldering or gluing with an adhesive. An aluminum enclosure can be cast or stamped from sheet. A plastic enclosure can be molded or stamped.

In addition to the principal components as described above it will be obvious to those skilled in the art that auxiliaries are also required to operate the unit:

1. a voltage source, such as batteries to power the laser unit and the light source;
2. a switch to operate the laser and light source; and
3. appropriate electrical connections such as wiring and fasteners, all of which will be obvious to those skilled in the art.

A preferred embodiment of the invention includes a calibrated target strip shown in FIG. 3. The target strip is preferably a strip with a linear scale showing distance from the outside edge of the hole. A preferred target is about 4 inches high and 36 inches long having a sequence of vertical lines spaced one inch apart. The target may also be reversible, with calibration lines on both sides of the target, to permit practice with left breaking or right breaking putts. A preferred target is self-supported by legs and positioned just behind the target hole. The strip is preferably enclosed in a clear plastic laminate for strength and protection.

The target plays an important part in using the apparatus. A golf green is often not a flat surface, and the proper strategy for reaching a hole is to aim the ball at a position which is displaced from the hole. The combination of the alignment device and the target allow the golfer to systematically choose different target positions and ball speeds and learn how to judge the break in a putt, while properly viewing the ball from a correct vertically aligned eye position.

A preferred method for using the apparatus includes the acts of:

1. Mounting a device on a putter having a substantially planar striking face, which produces:

a) a laser beam in a plane normal to the striking face of the putter just above the sweet spot, and b) produces an identifiable optical response when the putter head is viewed from a correct vertically aligned view substantially directly above the striking face.

2. Positioning a calibrated target strip having a series of vertical distance lines directly over or behind a target hole on the golf course.

3. Directing the laser beam towards a position on the target, while viewing the putter striking surface from a position vertically above the sweet spot such that the identifiable response is observed.

4. Striking a golf ball positioned in front of the striking head and allowing it to roll to a resting place.

5. Observing the path of the ball and the resting place relative to the hole.

6. If the ball did not go into the hole or reach the position of the hole on the target repeat steps 3 through 5.

Another way to use the target apparatus is to place it on a level surface and view the pattern drawn by the laser beam on the target. If the putter is properly soled and the path of the club is maintained such that the putter head striking surface is directed down the target line during the stroke, the line drawn on the target will be vertical and therefore parallel to the calibration lines on the target (assuming that the target is located perpendicular to the target line). If the putter head is not properly soled, or is rotated or deviates from the target line during the stroke, the line drawn by the laser will not be vertical during address and furthermore will appear to move horizontally across one or more of the calibration lines.

Although the present invention has been described in considerable detail with reference to certain preferred versions thereof other versions are possible. Therefore the spirit and scope of the appended claims should not be limited to the preferred versions herein.

I claim:

1. A putter training apparatus comprising an alignment device for mounting on a putter, the device comprising:

an enclosure having a first aperture and a second aperture;

a laser emitting unit which produces a laser beam, the laser device being mounted within the enclosure such that the laser beam passes through the first aperture; and a light source mounted within the enclosure, such that when the enclosure is mounted directly above a putter head having a substantially planar striking surface with the laser beam directed along a plane which is normal to the striking surface and with the second aperture facing upward the light source and the second aperture fall on a substantially vertical line proximate to the striking face.

2. The putter training apparatus defined in claim 1 wherein the light source is a convex light emitting diode.

3. The putter training apparatus defined in claim 2 further comprising a mounting means for removably attaching the device to a golf putter having a head with a substantially planar striking surface such that enclosure is mounted directly over the putter head with the laser beam directed along a plane which is normal to the striking surface with the second aperture directed upward and proximate to the striking surface.

4. The putter training apparatus defined in claim 3 wherein the device further comprises at least one lens mounted in the path of the laser beam which converts the laser beam into a line beam.

5. The putter training apparatus defined in claim 3, further comprising a calibrated visual target strip having a plurality of vertical graduation lines to deploy at a golf hole target, and wherein the laser emitting unit is so disposed within the enclosure that the laser beam strikes the target when the target is between 5 and 25 feet from the putter head.

6. The putter training apparatus defined in claim 4 further comprising a calibrated visual target strip having a plurality of vertical graduation lines to deploy at a golf hole target, and wherein the laser emitting unit is so disposed within the enclosure that the laser line strikes the target when the target is between about 5 and about 25 feet from the putter head.

7. The putter training apparatus defined in claim 1 wherein the opening in the second aperture is smaller than the diameter of the light source.

8. The putter training apparatus defined in claim 7 wherein the enclosure further comprises a plurality of surfaces within the enclosure within which the light source is mounted which form a guide from the light source to the second aperture.

9. The putter training apparatus defined in claim 8 wherein the light source is a light emitting diode.

10. The putter training apparatus defined in claim 9 further comprising a mounting means for removably attaching the device to a golf putter having a head with a substantially planar striking surface such that enclosure is mounted directly over the putter head with the laser beam directed along a plane which is normal to the striking surface with the second aperture directed upward and proximate to the striking surface.

11. The putter training apparatus defined in claim 10 wherein the device further comprises at least one lens mounted in the path of the laser beam which converts the laser beam into a line beam.

12. A The putter training apparatus defined in claim 11 further comprising a calibrated visual target strip having a plurality of vertical graduation lines to deploy at a golf hole target, and wherein the laser emitting unit is so disposed within the enclosure that the laser line strikes the target when the target is between about 5 and about 25 feet from the putter head.

13. The putter training apparatus defined in claim 10, further comprising a calibrated visual target strip having a plurality of vertical graduation lines to deploy at a golf hole target, and wherein the laser emitting unit is so disposed within the enclosure that the laser beam strikes the target when the target is between 5 and 25 feet from the putter head.

14. The putter training apparatus defined in claim 7 wherein the light source is a light emitting diode.

15. The putter training apparatus defined in claim 14 further comprising a mounting means for removably attaching the device to a golf putter having a head with a substantially planar striking surface such that enclosure is mounted directly over the putter head with the laser beam directed along a plane which is normal to the striking surface with the second aperture directed upward and proximate to the striking surface.

16. The putter training apparatus defined in claim 15 wherein the device further comprises at least one lens mounted in the path of the laser beam which converts the laser beam into a line beam.

17. The putter training apparatus defined in claim 16 further comprising a calibrated visual target strip having a plurality of vertical graduation lines to deploy at a golf hole target, and wherein the laser emitting unit is so disposed within the enclosure that the laser line strikes the target when the target is between about 5 and about 25 feet from the putter head.

18. The putter training apparatus defined in claim 15, further comprising a calibrated visual target strip having a plurality of vertical graduation lines to deploy at a golf hole target, and wherein the laser emitting unit is so disposed within the enclosure that the laser beam strikes the target when the target is between about 5 and about 25 feet from the putter head.

19. A putter training apparatus comprising an alignment device, the device comprising:

an enclosure means for mounting directly above a golf putter head having a substantially planar striking surface;

a laser means mounted within the enclosure for generating a laser beam which can be directed in a plane which is normal to the striking face; and a vertical alignment means mounted within the enclosure for generating an identifiable optical response when viewed by a golfer looking from directly above and vertically aligned with the vertical alignment means.

20. The putter training apparatus defined in claim 19 further comprising a mounting means for mounting the device directly above the putter head with the laser beam directed in a plane which is normal to the putter face with the vertical alignment means just behind the putter face.

21. The putter training apparatus defined in claim 20 further comprising a calibrated target to be placed at a golf hole target, and wherein the laser means is so disposed within the enclosure that the laser line strikes the target when the target is between about 5 and about 25 feet from the putter head.

22. A method for practicing putting comprising the acts of:

mounting a device on a putter having a substantially planar striking face wherein the device produces a laser beam in a plane normal to the striking face and further produces an identifiable optical response when the putter head is viewed from a vertically aligned view substantially directly above the striking face;

positioning a calibrated target strip at a desired target point;

directing the laser beam towards a position on the calibrated target strip while viewing the putter head such that the identifiable response is observed;

striking a golf ball positioned in front of the striking head and allowing it to roll to a resting place; and observing the resting place relative to the desired target point.

23. The method for practicing putting defined in claim 22 wherein the device produces a laser beam which is a line, and the calibrated target comprises vertical calibration lines, and the method further comprises:

observing the target during the golf stroke and observing whether the laser beam line visible on the target strip is parallel to the vertical calibration lines.

24. The method for practicing putting defined in claim 22 wherein the desired target point is a hole on a golf course.

* * * * *